United States Patent [19]

Jaegle

[11] 4,405,848

[45] Sep. 20, 1983

[54] ELECTRIC CONTACT ARRANGEMENT

[75] Inventor: Bruno Jaegle, Petershausen, Fed. Rep. of Germany

[73] Assignee: Siemens Aktiengesellschaft, Berlin & Munich, Fed. Rep. of Germany

[21] Appl. No.: 282,713

[22] Filed: Jul. 13, 1981

[30] Foreign Application Priority Data

Aug. 22, 1980 [DE] Fed. Rep. of Germany ..... 3031725

[51] Int. Cl.[3] ..... H01H 1/20

[52] U.S. Cl. ..... 200/243; 200/250; 267/158

[58] Field of Search ..... 200/290, 250, 245, 246, 200/243; 267/158

[56] References Cited

U.S. PATENT DOCUMENTS

| | | | |
|---|---|---|---|
| 2,758,169 | 8/1956 | Weide | 200/290 X |
| 3,258,548 | 6/1966 | Cartier et al. | 200/243 X |
| 3,403,236 | 9/1968 | Zoludow | 200/67 G |
| 3,694,590 | 9/1972 | Otterlei | 200/290 X |
| 3,882,056 | 5/1975 | Nakasone | 200/159 R X |
| 4,029,924 | 6/1977 | Frank et al. | 200/290 X |

FOREIGN PATENT DOCUMENTS

| | | | |
|---|---|---|---|
| 1244183 | 9/1960 | France | 267/158 |

*Primary Examiner*—John W. Shepperd
*Assistant Examiner*—Renee Kidorf
*Attorney, Agent, or Firm*—Hill, Van Santen, Steadman & Simpson

[57] ABSTRACT

An electric contact arrangement has a plurality of movable contact elements which are biased oppositely with respect to a like plurality of associated stationary contact elements by spring elements comprised of elastic plastic. The plastic spring elements may be formed on a contact carrier for use of the contacts as bridge contacts having a high degree of voltage stability.

12 Claims, 6 Drawing Figures

ELECTRIC CONTACT ARRANGEMENT

BACKGROUND OF THE INVENTION

The present invention relates to an electric contact arrangement with movable contact elements disposed opposite to associated stationary contacts wherein the movable contact elements are supported on a carrier and are biased by means of pressure springs in the direction toward the associated opposite stationary contacts.

Electric contact arrangements such as, for example, contact spring assemblies for relays, frequently employ elastic contact elements which, as a result of the inherent elasticity of the element, store forces and thus can generate a desired contact pressure. For specific applications, however, such as high current relays, longitudinally extended contact springs cannot be used because of the lack of voltage stability associated with such contacts. In these applications, rigid contact elements, which are biased or prestressed by means of associated separate pressure springs, are employed for switching. Such rigid contact elements are used in so-called bridge contact assemblies, wherein generally two stationary opposite contacts are connected by means of a common movable contact bridge during a switching process, in order to maintain relatively large clearances.

The pressure springs utilized in such high current assemblies are generally coil springs which are employed in order to attain a relatively weak spring constant in a narrow space. Such coil springs, for reasons of voltage stability, are customarily arranged in individual chambers of a carrier containing the contact elements, or containing the bridge contacts. This construction requires that not only must a relatively large number of individual parts be manufactured and assembled, but also that for such parts additional special refinements in shape must be undertaken in order to guarantee a satisfactory voltage stability.

SUMMARY OF THE INVENTION

It is an object of the present invention to provide a contact arrangement having a plurality of associated movable and fixed contacts wherein the movable contacts are supported on a carrier and are biased in the direction toward the associated opposite stationary contact which has a high degree of voltage stability and yet can be easily manufactured and assembled with as few parts as possible.

The above object is inventively achieved in a contact arrangement wherein the pressure springs are connected to the contact carrier and the contact elements and consist of elastic plastic.

By forming of the pressure springs from plastic, a simplification of the manufacturing process results because the springs are not electrically conducting and thus can be shaped without consideration of distances which would normally have to be maintained between conducting parts. Such plastic pressure springs can, for example, be leaf springs and thereby assume a significantly simpler shape than the customarily-used coil springs. Moreover, special insulating shields on the carrier, as are employed in conventional assemblies, are not necessary for the plastic pressure springs. The plastic springs may be manufactured in a work step, for example, in an injection molding process, so that the overall assembly and manufacturing process is significantly simplified in contrast to the manufacture of metal springs. The above shape and insulating advantages of the plastic springs can be attained even if the springs are manufactured individually as separate parts and subsequently fastened to the carried by means of plug fastenings, ultrasonic welding, or any other suitable manner known to those skilled in the art.

In a preferred embodiment of the invention, however, which simplifies manufacture and assembly to the greatest degree, the pressure springs are manufactured in one piece with the carrier for the contact elements. This embodiment is all the more desirable in those applications wherein a large number of contact elements and pressure springs are provided on a common carrier.

In a further embodiment of the invention, two pressure springs which are symmetrically carried on the contact carrier at their free ends upon a single contact element which is slidably supported on the carrier as a contact bridge. The carrier has a middle bar having a plurality of recesses therein each receiving one contact bridge. In this embodiment, the pressure springs are fastened laterally on the middle bar. In a further embodiment, cross bars may be provided on the carrier which are parallel to the contact elements and which have outer ends on which the pressure springs are formed as leaf springs which run toward the contact elements.

In those embodiments wherein the pressure springs are leaf springs, the springs are angled so as to form two sides of an isosceles triangle between the end which is fastened to the carrier and the free end which abuts the contact element. In this manner, a particularly large spring length and thus a relatively weak spring characteristic can be attained while the spring can still be housed in a narrow space.

It is preferable that the cross section of the plastic pressure springs between the fastening point and the free end of the springs is nonuniformly tapered so as to correspond to the bending stress curve for the plastic material comprising the spring so that a substantially equal bending stress is achieved over the entire spring length by means of increasing spring thickness or spring width from the actuation point, that is the free end, to the point where the maximum bending stress occurs.

The contact carrier may further carry a restoring spring which is isomorphic to the pressure springs and is also comprised of plastic. The restoring spring can, where applicable, also be formed on the carrier with the pressure springs. The plastic restoring spring has the same advantages as the pressure springs in simplification of manufacture and assembly and elimination of insulating problems.

The pressure springs and/or the restoring spring are comprised of a tough elastic plastic which has a relaxation which is as small as possible. Such springs exhibit a service life comparable to metal springs. The springs may, for example, be comprised of polyamide with fillers. Useful fillers are preferably taken from the group of polyimides (marketed under the trade name Aramid fibers), glass fibers, and carbon fibers.

DESCRIPTION OF THE PREFERRED EMBODIMENTS

Figure 1:
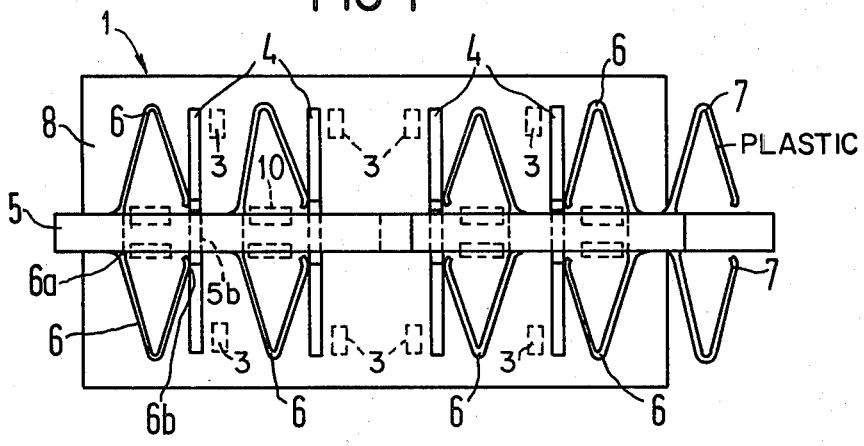
FIG. 1 is a plan view of a carrier with contact bridges and plastic springs for a bridge contact assembly constructed in accordance with the principles of the present invention.
Figure 2:
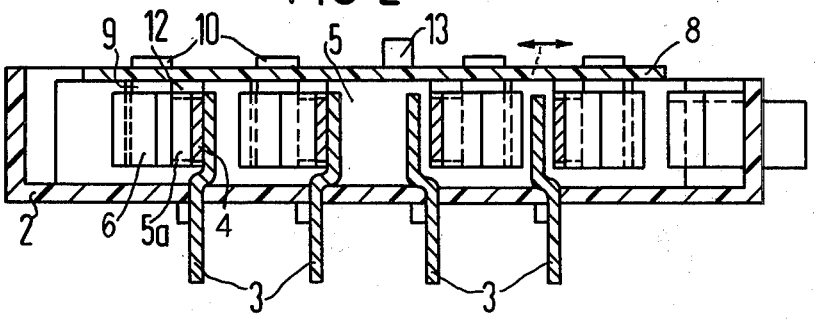
FIG. 2 shows the contact carrier of FIG. 1 in a fully-assembled bridge contact assembly.

A contact bridge carrier is shown in FIG. 1 which can be employed in a bridge contact assembly as is shown in FIG. 2, wherein the contact bridge carrier serves as a slide for moving certain contact elements. The bridge contact assembly 1 is inserted in a housing 2 which has a number of stationary fixed contact elements 3 anchored therein which cooperate with associated movable contact bridges 4 of the assembly 1 to make and break electrical connections. As shown in FIG. 2, the contact bridges 4 and the associated fixed contact elements 3 can be disposed so as to form a normally open or normally closed current path. The locations of the contacts 3 with respect to the assembly 1 are shown in dashed lines in FIG. 1, although it will be understood that the contacts 3 are not actually present in the planned view of the assembly 1.

The contact bridges 4 are individually supported in a like number of recesses 5*a* in a middle bar 5 of the carrier 1. The contact bridges 4 are biased by means of a plurality of pressure springs 6 which force each of the bridges 4 against a stop 5*b*. Depending upon the actuation of the carrier 1 which moves the middle bar 5, the contact bridges 4 are brought into connection with the associated opposite fixed contacts 3, at a contact pressure which is determined by the pressure springs 6.

The pressure springs 6 are in each case formed on the middle bar 5 of the carrier 1 and are symmetric about a longitudinal axis of the bar 5. A symmetrical contact pressure on the contact bridges 4, which are also disposed symmetrically with respect to the middle bar 5, is guaranteed. The individual pressure springs 6 are leaf springs which proceed from a fixed end 6*a* connected to the bar 5 to respective free ends 6*b* which abut the contact bridges 4. The pressure springs 6 are angled so as to form two sides of an isosceles triangle. By such a triangular shape a large spring length with a relatively weak spring characteristic is attained. At an end 1*a* of the carrier 1 are additionally disposed two symmetric restoring springs 7 which correspond in shape to the pressure springs 6. The restoring springs 7 support the carrier 1 in the housing 2 and reset the carrier 1 after the carrier 1 is actuated.

The pressure springs 6 and/or the restoring springs 7 can be separately molded out of plastic, such as by injection molding, and subsequently fastened on the bar 5 of the carrier 1 by plugs, welding, or any other suitable means known to those skilled in the art. The contact bridges 4 must also be attached to the carrier. From a manufacturing standpoint, however, it is preferable to manufacture the individual springs in one piece with the carrier 1, or at least with a portion of the carrier 1, such as the middle bar 5. When the carrier 1, as in the present example, has a middle bar 5 and a cover plate 8 over the contact bridges, it is preferable to design the carrier in two parts so that one part can be injected with the springs more easily. The other part, such as in the present case the cover plate 8, can then be subsequently connected in a simple manner with the middle bar 5.

Figure 3:
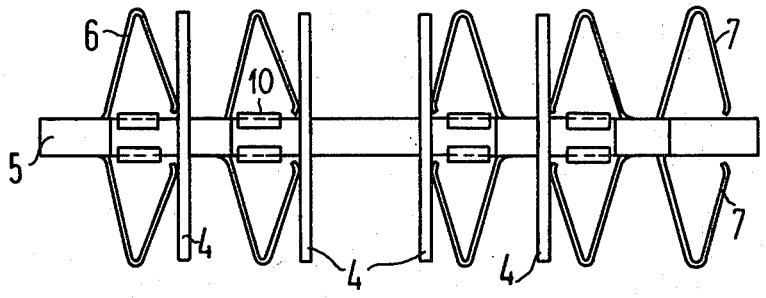
FIG. 3 is a plan view of the contact carrier shown in FIG. 1 isolated.
Figure 4:
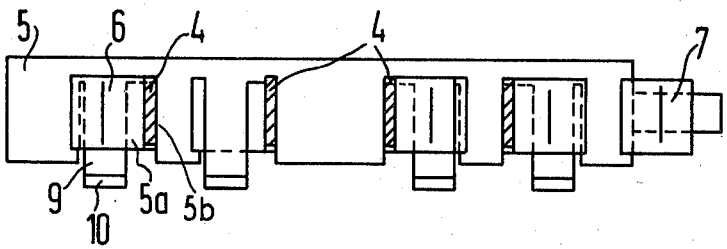
FIG. 4 is a side view of the contact carrier shown in FIG. 3.
Figure 5:
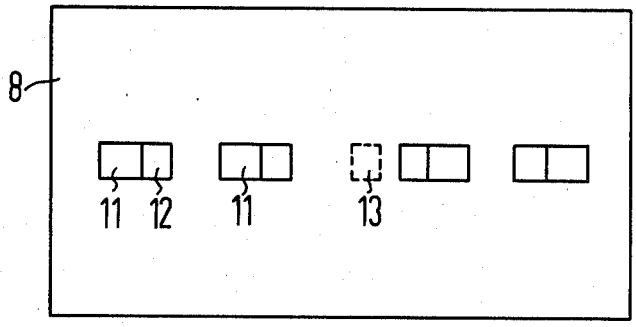
FIG. 5 is a plan view of a cover for the contact carrier shown in FIG. 1 isolated.

FIGS. 3 through 5 show such an embodiment. The carrier in this embodiment consists of the middle bar 5 which is shown in two views in FIGS. 3 and 4, as well as the cover plate 8 shown separately in FIG. 5. The middle bar 5 with the pressure springs 6 and the restoring springs 7 formed thereon has recesses 5*a* into which the contact bridges 4 are inserted so as to slide with respect to the bar 5. The middle bar 5 additionally carries a plurality of fastening stems 9, each having a hooked end 10 for locakbly fastening the stems 9 in recesses 11 of the cover plate 8. By such fastening to the cover plate 8, the contact bridges 4 are simultaneously secured from falling out of the recesses 5*a*. For this purpose, additional projections 12 are formed on the plate 8 which, when the middle bar 5 is connected with the plate 8, lie above the contact bridges 4. A cam 13 on the opposite side of the plate 8 serves in a known manner for actuating the carrier 1 as a slide element by means of the armature of a magnet system of the type well known to those skilled in the art which is not shown in the Figures and which forms no part of the invention herein.

Figure 6:
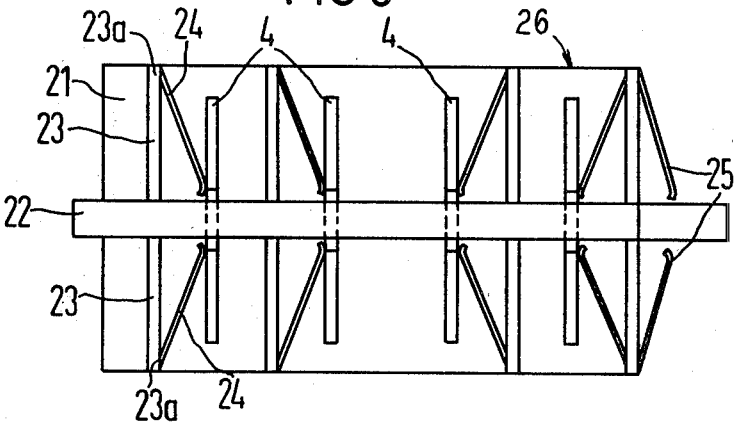
FIG. 6 is a second embodiment of the contact carrier with contact bridges and plastic springs for a bridge contact assembly.

FIG. 6 shows a second embodiment of the carrier referenced at 26. The carrier 26 has a plate 21 which covers a middle bar 22 in a manner identical to that shown in FIG. 1. The carrier 26 shown in FIG. 6 differs from the carrier 1 shown in the remaining Figs. by the spring construction. The carrier 26 has a plurality of side bars 23 which project substantially perpendicularly from the middle bar 22 on opposite sides thereof. The side bars 23 each have an outer end 23*a* to which one end of a pressure spring 24, or a restoring spring 25 is attached. The pressure springs 24 and the restoring springs 25 are each in the form of a leaf spring which are disposed at an inwardly running angle toward the middle bar 22 and have free ends which abut the contact bridges 4 or the side of a housing in which the carrier is placed. The embodiment shown in FIG. 6 is simpler to construct than the triangular-shaped springs shown in the remaining Figs. and can be employed when space considerations permit a spring length as is shown in the embodiment of FIG. 6 not to interfere with the remaining construction.

In order to assure a uniform spring constant over the entire length of the pressure spring 6 and the restoring spring 7, the cross section of those springs can be of a tapering design in accordance with a curve for the elastic characteristics of the plastic material comprising the springs representing the spring force versus the distance from the fixed end of the spring.

Although modifications and changes may be suggested by those skilled in the art it is the intention of the inventor to embody within the patent warranted hereon all changes and modifications as reasonably and properly come within the scope of his contribution to the art.

I claim as my invention:

1. An electric contact arrangement comprising a plurality of movable contact elements and a like plurality of pairs of fixed contact elements, each pair of fixed contact elements being respectively associated with a movable contact element for making and breaking an electrical connection, a slidable carrier having a longitudinally extending centrally disposed bar having a plurality of notches therein for respectively receiving and retaining said movable contact elements for making and breaking with said pairs of fixed contact elements upon actuation of said carrier, a plurality of elastic plastic pressure springs laterally attached to sides of said bar of said carrier and respectively associated with said movable contact elements for biasing said movable contact elements in a direction toward an associated fixed contact element pair, a coverplate having a plurality of recesses therein, and said bar having a plurality of stems extending therefrom receivable in said recesses for retaining said bar against said cover plate.

2. The electric contact arrangement of claim 1 wherein said pressure springs are separate pieces and are attached to said carrier by a fastening means.

3. The electric contact arrangement of claim 1 wherein said pressure springs are simultaneously formed with said carrier and said carrier and pressure springs are a onepice unit.

4. The electric contact arrangement of claim 1 wherein two pressure springs are respectively associated with each of said movable contact elements, said two pressure springs each being symmetrically attached to said bar of said carrier at a fixed end and each having a respective free end abutting said movable contact element.

5. The electric contact arrangement of claim 1 further comprising a plurality of cross bars extending perpendicularly from said bar, said pressure springs each having a fixed end attached to an outer end of each of said cross bars and a free end abutting a movable contact element.

6. The electric contact arrangement of claim 1 wherein said pressure springs each have a fixed end attached to said carrier and a free end abutting a movable contact element and have an angle between said fixed end and said free end such that said pressure spring is in the form of two sides of an isosceles triangle.

7. The electric contact arrangement of claim 1 wherein said pressure springs have a tapering cross section which corresponds to the spring characteristics of said elastic plastic such that said pressure springs exhibit equal spring force over their entire length.

8. The electric contact arrangement of claim 1 further comprising a plurality of restoring springs carried at one end of said carrier corresponding to said pressure springs for resetting said carrier after actuation thereof.

9. The electric contact arrangement of claim 8 wherein said plastic comprising said restoring springs is polyamide with fillers.

10. The electric contact arrangement of claim 9 wherein said fillers are selected from the group consisting of polyimides, glass fibers, and carbon fibers.

11. The electric contact arrangement of claim 1 wherein said elastic plastic comprising said pressure springs consists of polyamide with fillers.

12. The electric contact arrangement of claim 11 wherein said fillers are selected from the group consisting of polyimides, glass fibers and carbon fibers.

* * * * *